US005080138A

United States Patent [19]

Haviv

[11] Patent Number: 5,080,138

[45] Date of Patent: Jan. 14, 1992

[54] VALVE ASSEMBLY WITH MULTI-PART VALVE BODY

[75] Inventor: Shlomo Haviv, Bronx, N.Y.

[73] Assignee: Reseal International Limited Partnership, New York, N.Y.

[21] Appl. No.: 607,371

[22] Filed: Oct. 31, 1990

[51] Int. Cl.[5] ..... F16K 15/14

[52] U.S. Cl. ..... 137/853; 222/494

[58] Field of Search ..... 222/494; 137/853, 860

[56] References Cited

U.S. PATENT DOCUMENTS 3,534,771 10/1970 Eyerdam ..... 222/494 X 3,902,664 11/1974 Deines ..... 222/494 X

*Primary Examiner*—Robert G. Nilson

*Attorney, Agent, or Firm*—Toren, McGeady & Associates

[57] ABSTRACT

A fluid dispensing valve is made up of a plural part valve body enclosed by an elastomeric sheath sealed at spaced locations to the outside surface of the valve body. Fluid is dispensed out of a container through the dispensing valve. The arrangement of the valve body parts and the sheath permit flow out of the valve but prevent any flow back into the container. As a result contamination can not flow back through the valve into the container.

14 Claims, 3 Drawing Sheets

VALVE ASSEMBLY WITH MULTI-PART VALVE BODY

BACKGROUND OF THE INVENTION

The present invention is directed to a multi-part valve body for discharging a fluid from a container, such as a flexible collapsible container, while preventing back flow into the container, particularly of contaminants. The valve assembly is formed of an axially extending valve body with a first or inlet end part containing a flow passage, a second or outlet end part also containing a flow passage and a third or intermediate part between the first and second end part with the third part being imperforate. An elastomeric sheath tightly encloses the three parts. The elastomeric sheath can expand outwardly permitting the different parts to separate in the axial direction and affording a flow of fluid from the inlet end part to the outlet end part within the elastomeric sheath.

In dispensing sterile fluids from a container, especially when the container has an extended use lifetime, it is important to prevent any back flow of contaminants into the container during and following the dispensing operation. Contamination from the ambient atmosphere may include microorganisms, atmospheric gases, moisture, dust and the like. If a sterile fluid is contaminated it can affect its quality, potency and even the safety of the fluid.

If a container of sterile fluid has a one-time use and is not intended to be dispensed over an extended period of time, the problem of contaminants entering the container usually does not exist.

Sterile fluid may involve a variety of products, such as drugs, beverages, cosmetics and the like. The fluid may be a liquid, lotion, cream, gel, powder, gas or the like.

The present invention is an improvement on the valve assembly disclosed in the U.S. Pat. No. 4,846,810 hereinafter referred to as the ReSeal Valve. In the ReSeal Valve a unitary valve body was used enclosed within an elastomeric sheath. While the ReSeal Valve is effective in maintaining the sterility of a fluid within a container, the formation of the flow passages through the valve body can increase its cost.

SUMMARY OF THE INVENTION

The primary object of the present invention is to provide an improvement of the ReSeal Valve and particularly to limit the costs of forming the flow passageways through the valve body.

In accordance with the present invention, the axially extending valve body is divided into three parts, a first or inlet end part with a flow passage through it, a second or outlet end part with a flow passage through it, and an imperforate third or intermediate part located between the first and second parts and maintaining them in spaced relation. An elastomeric sheath is tightly fitted around the three parts and held in sealed contact with the end parts. The elastomeric sheath is capable of expanding radially outwardly and also in the axial direction. The elastomeric sheath tightly encloses the outer surfaces of the three parts so that in the at rest condition no flow can pass between the inlet end and the outlet end of the valve body, either into or out of the container.

Preferably, the first and second valve body parts have axially extending passageways through them for discharging a fluid out of a container to which the valve assembly is connected. The valve assembly has an advantage over the ReSeal Valve in not requiring any flow passages extending transversely of the axial direction of the valve body.

In use, the fluid is pressed out of a container into the passageway through the first end part. The pressure exerted by the fluid separates the first and third parts, whereby the fluid flows into the space between the parts and then radially outwardly to the inside surface of the elastomeric sheath causing the sheath to expand. As the sheath expands the second end part moves axially away from the third part and the fluid can then flow radially inwardly between the second and third parts and enter into the passageway through the second part for flow out of the valve body. When the fluid has been dispensed, the elastomeric sheath rebounds and returns the three parts into the original at-rest position and prevents any flow through the passageway of the second end part back into the container. With the elastomeric sheath fitting tightly against the surface of the three parts and holding the three parts together in the axial direction, any flow from the ambient atmosphere back through the outlet passageway in the second part is blocked by the imperforate intermediate part.

The transverse surfaces between the first part and third part and between the third part and second part can be in contact across the full surface of the parts. To facilitate the separation of the parts when the fluid is dispensed out of the container, at least one of the first and second parts can have a dished or conical surface with a similarly shaped contacting surface on the third part so that the pressure acting to separate the parts is increased when the fluid acts on the shaped surfaces.

The seal between the elastomeric sheath and the valve body can be provided by O rings tightly pressing the sheath against the valve body. In one embodiment the O rings can press the sheath into an annular groove or recess in the valve body. As an alternative, a sleeve encircling the sheath can be provided with annular projecting parts pressing the elastomeric sheath into sealed engagement with the surface of the valve body. Further, the sheath could be secured to the valve body by means of an adhesive, by welding, or by a variety of other known procedures. It is important that the sheath is sealed to the valve body relative to the direction of flow from the inlet passageway to the outlet passageway, so that the sheath is sealed at locations upstream and downstream from the intermediate part.

If a sleeve is used to enclose the valve body, it is important that a vent is provided for the sleeve, so that the elastomeric sheath returns into tightly sealing engagement with the valve body surface when any dispensing of the fluid is completed. In a preferred arrangement, the sleeve can be provided in two parts, one attached to the first end part of the valve body and the other attached to the second end part. The two parts of the sleeve can move axially apart from one another when the fluid to be dispensed is pressurized and flows through the valve, whereby the sleeve parts separate and form a vent assuring that the sheath will return into tightly fitting engagement with the valve body.

The design of the inner surface of the elastomeric sheath and its elastic properties will define the amplitude and frequency of oscillation of the valve body parts and the type of flow of the fluid through the valve body.

Since only axially extending passageways are required through the first and second valve body parts, the production of the valve body is simplified and the need for complex tools for creating radially extending passageways is eliminated.

If a two part sleeve is used to enclose the elastomeric sheath, the need for providing a vent hole can be eliminated.

The construction of the valve body and the tight fitting of the sheath about the valve body assures that no contamination can flow back into the container through the different parts.

It is possible to incorporate means along with the valve body to provide metered dosage, especially for pharmaceuticals.

Materials used in the valve assembly can be selected based on the fluid to be dispensed and the sterilization methods used on the fluid. If thermal sterilization is used, the materials selected must maintain their integrity throughout the full temperature range of sterilization and for the time period required. Sterilization can be carried out in other ways, such as by radiation, ethylene oxide and the like.

A significant feature of the valve assembly preventing contaminants from entering the container, is that it is unnecessary to add preservatives to the fluid. The use of preservatives may be costly, affect the potency of the fluid, and provide potentially harmful side effects.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
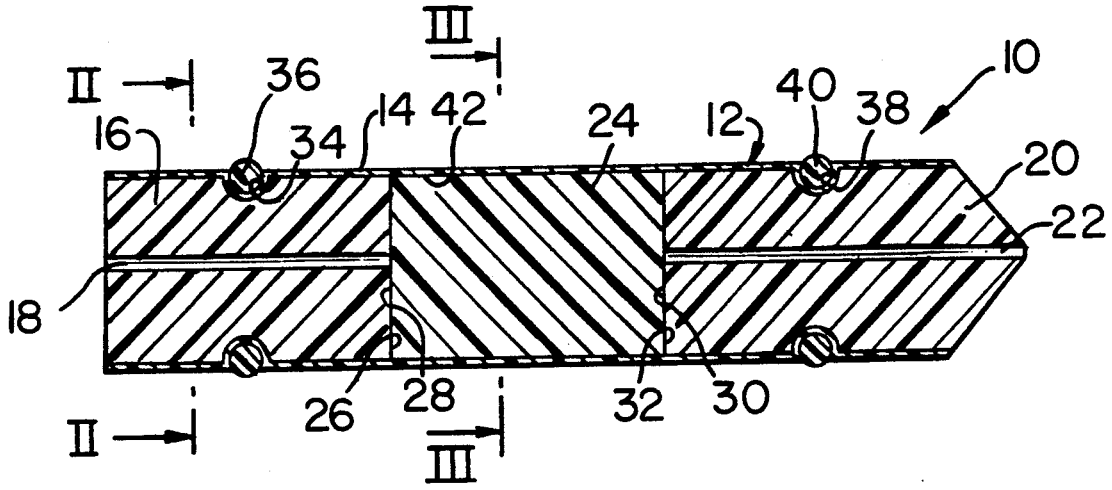
FIG. 1 is a diagrammatic sectional view of a valve assembly embodying the present invention.

In FIG. 1 an axially extending cross section is shown of a valve assembly 10 formed by a multi-part valve body 12 and an elastomeric sheath 14 laterally enclosing the valve body. Though not illustrated, the valve assembly would be connected at its inlet or left hand end to a container holding a fluid to be dispensed. Preferably, the container is a flexible container and by pressing the container the fluid is forced out through the valve assembly. Valve body 12 is made up of a first or inlet end part 16 having a first passageway 18 extending axially through the first part. At the opposite end the valve body is formed by a second end part 20 with a second passageway 22 extending axially through the second part. Between the first and second parts is a third or intermediate part 24. The third part 24 is imperforate, that is, it is a solid member or at least does not contain a passageway for flow from the first passageway 18 to the second passageway 22.

Figure 9:
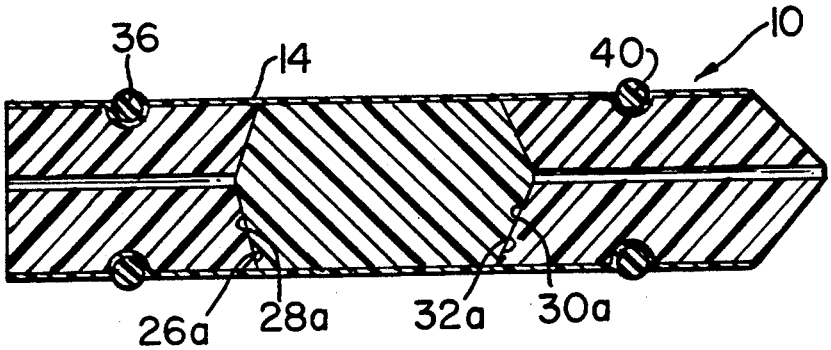
FIG. 9 is an axial section, similar to FIG. 1 showing dished end surfaces on the valve parts.

First part 16 has an end surface 26 extending transversely of the axial direction and preferably perpendicularly to the axis and in contact with the transversely extending end surface 28 on the third or intermediate part 24. Similarly, the second part has a transverse end surface 30 in contact with a transverse end surface 32 on the third part. While the surfaces 26, 28 and 30, 32 are shown in full contact, it is possible at least in the region of the first and second passageways 18, 22 to provide a concave surface for facilitating the dispensing of fluid out of the container. The concave surface can be on one or both of the facing end surfaces. Note in FIG. 9 concave surfaces 26*a*, 28*a*, 30*a* and 32*a* are shown on the adjacent end surfaces of the first part 16, second part 20 and third part 24.

The elastomeric sheath 14 is sized so that it fits tightly around the three parts 16, 20 24. The sheath is selected so that its inside diameter is less than the outside diameter of the three parts whereby the sheath fits tightly around each of the parts. In the first part 16 intermediate its ends there is an annular groove 34 into which the sheath 14 is pressed in sealing engagement with the first part by an 0 ring 36. Similarly, the second part 20 has an annular recess 38 into which the elastomeric sheath 14 is pressed by an 0 ring 40 so that the sheath is sealed to the second part. The sealed contact of the elastomeric sheath 14 with the first and second parts 16, 20 is particularly significant, since it prevents any inward flow between the sheath and the valve body to reach past the O rings 36, 40 and enter into the space between the inner surface of the elastomeric sheath 14 and the outer surface of the valve body 12.

When pressure is applied to the container holding the fluid to be dispensed, the fluid flows into the first passageway 18 toward the surface 28 of the third part 24. The pressure of the fluid acting on the surface 28 causes the first part and third part to separate in the axial direction so that the fluid flows from the passageway 18 between the surfaces 26 and 28 radially outwardly to the inside surface 42 of the sheath 14. In addition to expanding in the axial direction due to the movement of the third part 24 away from the first part 16, the fluid expands the sheath 14 radially, so that the fluid can flow between the outside surface of the third part 24 and the inside surface 42 of the sheath 14. As the fluid flows toward the second or outlet part 20, the third part and second part separate so that the fluid can flow radially inwardly from within the sheath to the second passageway 22 which forms the outlet channel of the valve assembly 10. When the pressure applied to the container is released as the sheath forces the fluid toward the second passageway 22 the sheath rebounds inwardly back into sealing engagement with the parts of the valve body and the first and second parts move into contact with the corresponding ends surfaces of the third or intermediate part sealing off flow from the second passageway back toward the first passageway 18 and its associated container.

Accordingly, the multi-part valve body 12 in combination with the sheath 14 assures that flow out of the container can be carried out while any backflow of the contaminants into the container is prevented. Any flow into the second passageway 22 is blocked by the combined facing surfaces of the second end part 20 and the third or intermediate part 24 and the sheath 14 which secures the parts together and blocks any flow into the space between the valve body and the inside surface of the sheath.

Figure 2:
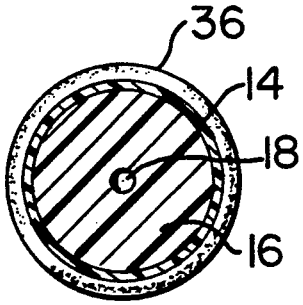
FIG. 2 is a sectional view taken along the line II—II in FIG. 1.
Figure 3:
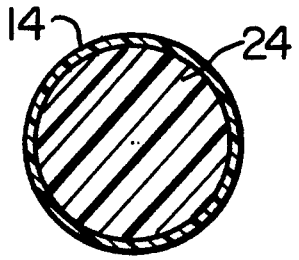
FIG. 3 is a sectional view taken along the line III—III in FIG. 1.

In the embodiment of FIGS. 1, 2 and 3 the sheath is not laterally enclosed outwardly. As a result, when the sheath is expanded outwardly it will return into contact with the valve body when the fluid has been dispensed. It has been known to laterally enclose the valve body and the sheath within a sleeve to limit the radial displacement of the sheath. If the inside of the sleeve is not vented there is the possibility that the sheath may be retained in the expanded condition and not return into tightly fitting contact with the valve body. As a result, a vent hole is provided in the sleeve to assure that the sheath returns into tightly fitting contact with the valve body.

Figure 4:
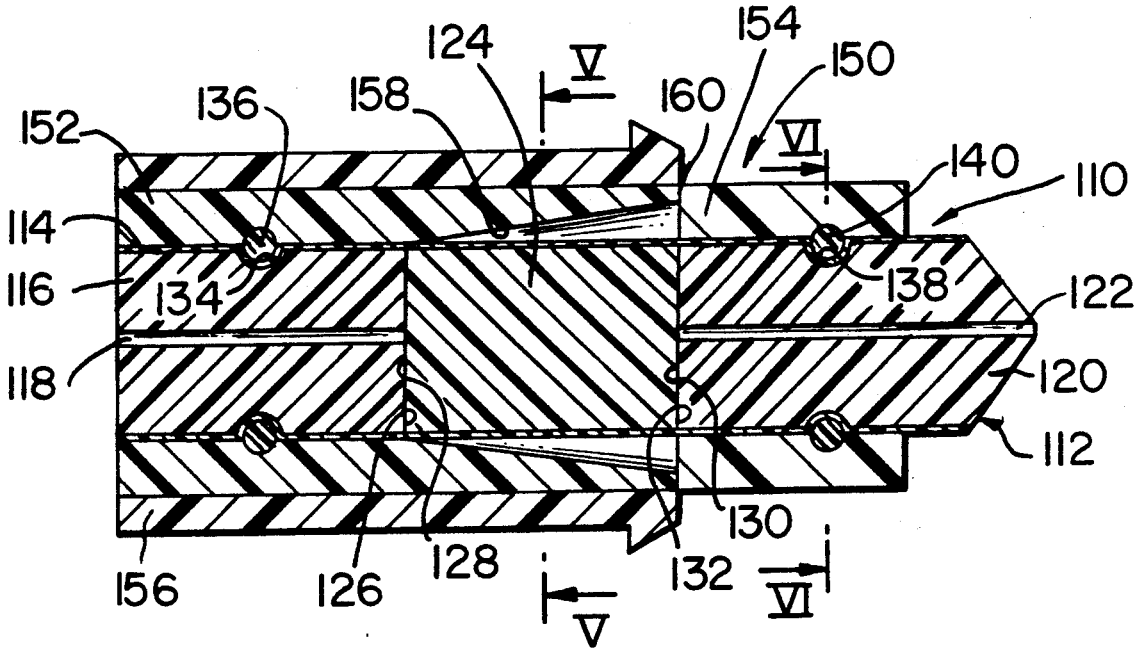
FIG. 4 is a diagrammatic sectional view of another embodiment of a valve assembly incorporating the present invention.
Figure 5:
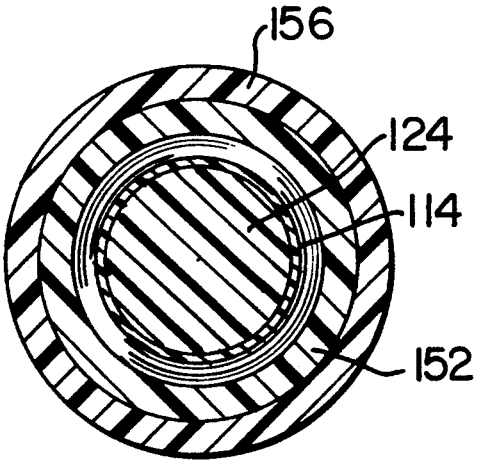
FIG. 5 is a sectional view taken along the line V—V in FIG. 4.
Figure 6:
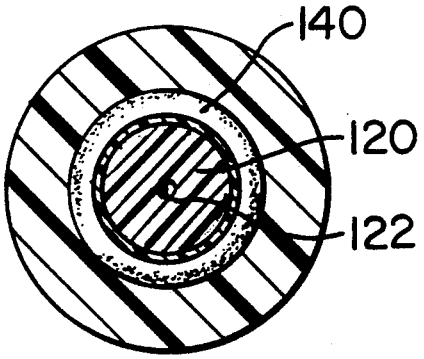
FIG. 6 is a cross-sectional view taken along the line VI—VI in FIG. 4.

In FIGS. 4, 5 and 6 a two-part sleeve 150 is shown enclosing a valve assembly 110 similar to that shown in FIG. 1. In FIG. 4 parts of the valve assembly 110 similar to the embodiment of FIG. 1 have the same reference numerals with the addition of the prefix 1. The purpose of the valve assembly 110 and sleeve 150 is to limit the radially outward displacement of the elastomeric sheath 114 in the region of the third or intermediate part 124.

The two-part sleeve 150 is made up of a first sleeve part 152 laterally enclosing the first end part 116 and the intermediate part 124. The first sleeve part 152 extends in the direction of flow through the valve assembly to the plane containing the contacting surfaces 130, 132 of the second end part 120 and the intermediate part 124. A second sleeve part extends from the plane of the surfaces 130, 132 toward the outlet end of the valve body 112 and terminating between the outlet and the O ring seal 140.

The first sleeve part 152 secures the O ring 136 in sealed engagement with the sheath 114 within the annular groove 134. Similarly, the second sleeve part 154 holds the O ring 140 against the sheath 114 within the annular groove 138. Accordingly, flow between the elastomeric sheath and the surface of the valve body 11 is blocked by the combination of the sleeve parts and the O rings.

The valve assembly 110 is mounted in the outlet of a container with the neck 156 of the container laterally enclosing the first sleeve part 152 up to the plane of the surfaces 130, 132.

The first sleeve part 152 fits closely against the outside surface of the sheath 114 for the axial length of the first end part 116. In the axially extending range of the intermediate part 124, the inside surface 158 of the first sleeve part 152 tapers outwardly in a conical manner from the plane of the surfaces 126, 128 to the plane of the surfaces 130, 132. In the plane of the surfaces 130, 132 the first sleeve part abuts against an end of the second sleeve part 154. As a result, in the at-rest condition of the valve assembly 110, the space between the surface 158 of the first sleeve part 15 and the outer surface of elastomeric sheath 114 is sealed.

In operation, the valve assembly 110 operates in the same manner as the valve assembly 10 described above. In the valve assembly 110, however, with the addition of the sleeve 150 there is formed a conically shaped space 162 around the elastomeric sheath 114 in the range of the intermediate part 124, so that when fluid is forced out of the container through the passageway 118 it radially expands the sheath toward the surface 158. With axial displacement of the different parts of the valve body as the fluid is dispensed, when the second end part 120 moves axially away from the intermediate part 124 the first sleeve part 152 and the second sleeve part 154 separate forming a vent 160. As a result, the space 162 between the surface 158 of the first sleeve part 152 and the outer surface of the sheath 114 is vented providing pressure acting on the outer surface of the sheath so that it moves back into sealing contact with the outside surface of the intermediate part 24 when the fluid is dispensed out of the valve assembly 110.

With the multi-part arrangement of the valve body 112, it is necessary that the sleeve 150 is formed of two parts permitting the parts of the valve body to move axially relative to one another as the fluid is dispensed.

Figure 7:
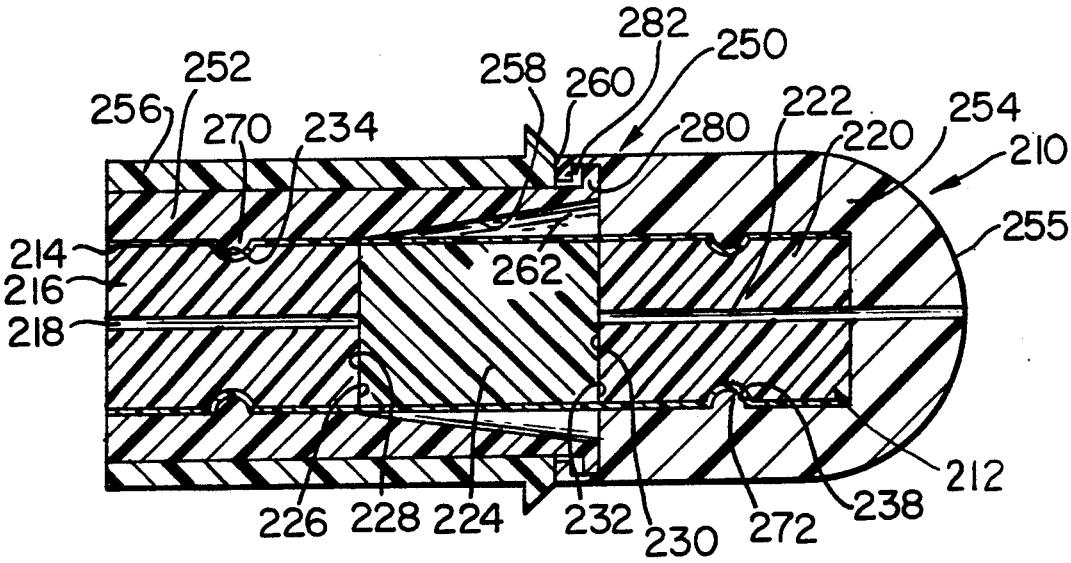
FIG. 7 is a diagrammatic sectional view of still another embodiment of a valve assembly incorporating the present invention.

In FIG. 7 another embodiment of a valve assembly 210 is illustrated similar to the valve assembly 110 in FIG. 4, however, with a different arrangement of the vent and without the use of O ring seals for securing the elastomer sheath in sealed engagement with the valve body.

In FIG. 7 parts similar to those in FIGS. 1 and 4 have the same reference numeral, however, with the addition of the prefix 2. The arrangement of valve assembly 210 is similar to that shown in FIG. 4, however, the O rings 136, 140 are not used, there is a different arrangement of the vent 160, and the second sleeve part 254 is different, particularly in the arrangement of the sleeve part at the outlet from the valve body 212.

In place of the O rings 136, 140, an annular protuberance 270 is provided on the inside surface of the first sleeve part 252 and a similar protuberance 272 is formed on the inside surface of the second sleeve part 254. These protuberances 270, 272 extend into the annular grooves 234, 238 and press the sheath 214 against surface of the respective valve body parts. The protuberances 270, 272 provide a sealing effect between the sheath 214 and the valve body surface preventing any flow past the protuberances into the space 262 in the axially extending range of the intermediate part 224.

Adjacent to the plane of the contacting surfaces 230, 232, the cooperating ends of the first sleeve part 252 and of the second sleeve part 254 have an interfitting arrangement. The first sleeve part 252 has an outwardly projecting annular flange 280 while the second sleeve part 254 has a inwardly projecting annular flange 282 the two flanges define a vent 260. In the at rest condition of the valve assembly 210 the cooperating ends of the first sleeve part 252 and the second sleeve part 254 in the plane of the surfaces 230, 232 form a seal for the space 262. When fluid is dispensed through the valve and the parts move axially relative to one another as the second end part 220 moves away from the intermediate part 224 the two flanges move toward one another forming a stop arrangement for such axial movement. As the flanges move toward one another the end surface of the first sleeve part in the plane of the surfaces 230, 232 separates from the cooperating surface of the second sleeve part 254 permitting a venting action. As a result, the vent connected with ambient atmosphere assures that the elastomeric sheath 214 will return into sealed contact with the intermediate part 224 of the valve body when the discharge of fluid has been completed.

As can be noted in FIG. 7, the flange 282 on the second sleeve 254 abuts against the end of the container neck 256 in the at rest condition. When the second sleeve part 254 moves axially from the intermediate part 224 the flange 282 moves away from the end of the container neck 256 so that the space 262 is vented to the ambient atmosphere.

In FIG. 7 the second sleeve part 254 has an outlet end section 255 shaped to provide the desired outlet flow of the fluid from the container. The section 255 forms a continuation of the outlet passageway 222 through the second end part 220 of the valve body.

Figure 8:
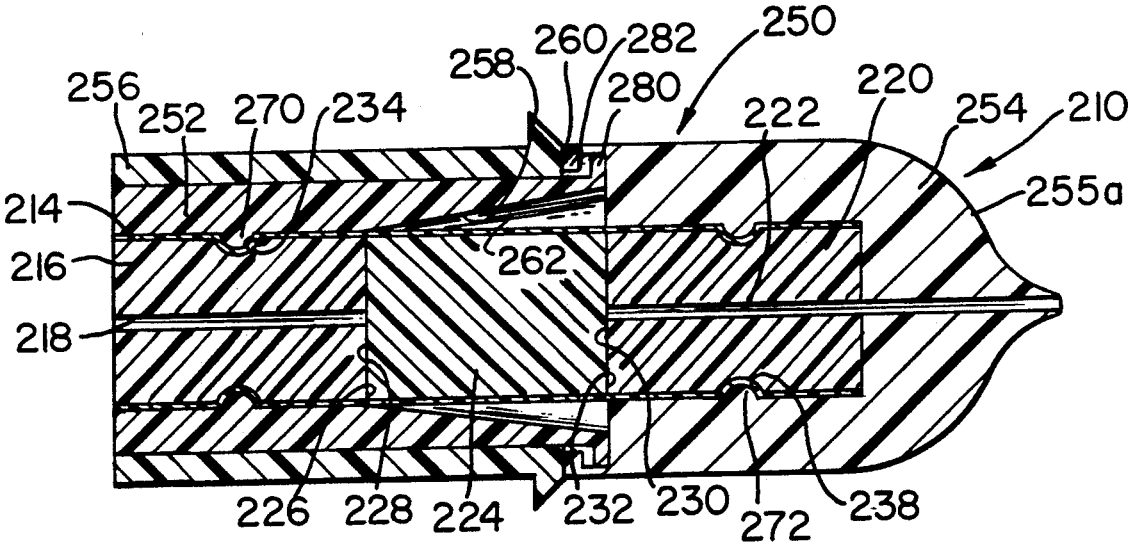
FIG. 8 is a sectional view, similar to FIG. 7, but with a differently shaped outlet end section.

In FIG. 8 there is shown another embodiment of the section 255*a* for controlling the outlet flow of the fluid.

During operation of the valve assembly 10, 110, 210 the sequential expansion of the elastomeric sheath in the axial direction and in the radially outward direction creates an oscillating effect, and the amplitude and frequency of the sheath can be adjusted by the arrangement of the protective sleeve and the elastic properties of the sheath. The shape of the section 255, 255*a* of the second sleeve part 254 determines flow from the valve assembly whether in the form of drops, mist, stream or other form. By providing a particular shape for the section 255, 255*a* the volume trapped at the outlet of the valve assembly can be minimized, thereby reducing any sterility problems at the outlet or tip of the valve assembly.

The materials used for the valve body and the elastomeric sheath can be selected for compatibility with the fluid being dispensed and with any sterilization method used on the fluid. If thermal sterilization is used, the materials must maintain their integrity throughout the temperature ranges and time period required for sterilization. In addition to thermal sterilization, irradiation, ethylene oxide or other means can be used.

Since the valve assembly prevents any backflow of the contaminants into the container while fluid is being dispensed, there is no need to add preservatives which might be costly, could affect the potency of the product or produce potentially dangerous side effects. The valve assembly can be used to dispense various types of fluids, such as liquids, lotions, creams, gels, powders, gas and the like. The valve assembly can be used to dispense a wide variety of products, such as foods, pharmaceuticals, cosmetics, industrial chemicals, photographic solutions, adhesives, paints and the like.

The different parts of the valve body and the enclosing sleeve can be molded in a single process step, using different materials if necessary, and can be designed for a wide range dispensing applications.

While specific embodiments of the invention have been shown and described in detail to illustrate the application of the inventive principles, it will be understood that the invention may be embodied otherwise without departing from such principles.

I claim:

1. A fluid dispensing valve comprising an axially extending plural part valve body having a first end and second end spaced apart in the axial direction and an elastomeric sheath extending in the axial direction and laterally enclosing at least a part of the said valve body in the axial direction, said elastomeric sheath tightly enclosing said valve body and being expandable radially outwardly therefrom and axially thereof, said valve body having an axially extending first end part extending from the first end toward the second end, an axially extending second end part extending from the second end toward and spaced from the first end part, and an axially extending third part extending between said first and second end parts, said first end part has a laterally enclosed first outlet passageway extending from said first end to said third part, said second end part has a laterally enclosed second outlet passageway extending from said third part to the second end and said third part being imperforate whereby fluid under pressure flows through said first outlet passageway to between said first end part and third part with said first end part and third part separating in the axial direction so that the fluid flows radially outwardly to the inside of the said sheath and between said sheath and said third part for flow radially inwardly between said third part and said second end part and then out through said second outlet passageway.

2. A fluid dispensing valve, as set forth in claim 1, including means for sealing said sheath to said first end part and said second end part.

3. A fluid dispensing valve, as set forth in claim 2, wherein said sealing means comprises an annular groove formed in the outside surface of each of said first end part and said second end part, and an O ring pressing said sheath into each said annular groove for sealed engagement of said sheath with said first end part and second end part.

4. A fluid dispensing valve, as set forth in claim 2, wherein said means comprises a two-part sleeve laterally enclosing said elastomeric sheath, said first and second end parts each having an annular groove therein spaced from said third part, said two-part sleeve comprising a first sleeve part laterally enclosing said first end part and third part and a second sleeve part laterally enclosing at least said second end part, each of the said first and second sleeve parts having an annular radially inwardly extending protuberance arranged to press said sheath into said annular grooves in said first and second end parts, and said annular grooves in said first and second end parts, and said first sleeve part having an end in contact with an end of said second sleeve part in and at-rest condition of said valve.

5. A fluid dispensing valve, as set forth in claim 1, wherein a two-part sleeve laterally encloses said valve body, said two-part sleeve comprising a first sleeve part extending around said first end part and said third part, and a second sleeve part extending around said second end part, and said first sleeve part having an end in contact with an end of said second sleeve part in an at-rest condition of said valve, whereby in dispensing the fluid through said valve, said first end part and said third part and said third part and said second end part move axially apart whereby the contacting ends of said first and second sleeve parts move apart in the axial direction providing a vent to a space located between first sleeve part and said elastomeric sheath encircling said third part.

6. A fluid dispensing valve, as set forth in claim 5, including means for securing said first sleeve part to said first end part and said second sleeve part to said second end part so that said first and second sleeve parts move axially relative to one another when fluid is dispensed through said valve body.

7. A fluid dispensing valve, as set forth in claim 6, wherein said means comprises an O ring seated in an annular groove in each said end part and into a corresponding annular groove in an inside surface of said first and second sleeve parts whereby said O rings press said sheath into sealing engagement with said first and second end parts and secure said first sleeve part to said first end part and said second sleeve part to said second end part whereby said first sleeve part moves axially relative to said second sleeve part when fluid is dispensed through said valve body.

8. A fluid dispensing valve, as set forth in claim 1, wherein said first end part has an end surface in surface contact with an end surface of said third part and said second end part has an end surface in surface contact with another end of said third part whereby contacting said end surfaces move axially apart when fluid is dispensed through said valve body.

9. A fluid dispensing valve, as set forth in claim 8, wherein said contacting end surfaces of said first end part and said third part and of said second end part and said third part extend perpendicularly of the axis of said valve body and are in surface contact for the complete surfaces thereof.

10. A fluid dispensing valve, as set forth in claim 8, wherein at least one of the said contacting surfaces of said first end part and said third part and of said second end part and said third part being concave and encircling said passageway through said first end part or said second end part.

11. A fluid dispensing valve, as set forth in claim 4 or 5, wherein said first sleeve part and second sleeve part adjacent to the contacting ends thereof are in overlapping relation, each of said first and second end parts having a flange in spaced facing relation in the at-rest condition of said body with one of said first and second sleeve parts extending in telescoping relation relative to the other one of said first and second sleeve parts whereby in the at-rest condition said flanges are in spaced relation and in the operating condition of said valve body said flanges move toward one another and provide a vent for a space between said first valve part and said elastomeric sheath enclosing said third part.

12. A fluid dispensing valve, as set forth in claim 4 or 5, wherein said second sleeve part extends axially beyond and across an end surface of said second end part spaced from an end surface of said second end part in contact with said third part, and said second sleeve part forming a section having a passageway therethrough providing an extension of said second passageway through said second end part.

13. A fluid dispensing valve, as set forth in claim 12, wherein said second sleeve part is shaped to control the flow of the fluid out of said valve body.

14. A fluid dispensing valve, as set forth in claim 4 or 5, wherein said first sleeve part in the axial range of said third part has an inside surface sloping outwardly from said third part in the direction toward said second end part, and forming a conically shaped space between said sheath and the outwardly sloping inside surface.

* * * * *